US008967047B2

(12) United States Patent
Kraft et al.

(10) Patent No.: US 8,967,047 B2
(45) Date of Patent: Mar. 3, 2015

(54) IGNITER BASE FOR PYROTECHNIC DEVICES

(71) Applicant: A & O Technologie GmbH, Schoenebeck/Elbe (DE)

(72) Inventors: Andre Kraft, Schoenebeck/Elbe (DE); Christian Kuhn, Leipzig (DE); Olaf Jurkowski, Schoenebeck/Elbe (DE)

(73) Assignee: A & O Technologie GmbH, Schoenebeck/Elbe (DE)

( * ) Notice: Subject to any disclaimer, the term of this patent is extended or adjusted under 35 U.S.C. 154(b) by 9 days.

(21) Appl. No.: 13/799,003

(22) Filed: Mar. 13, 2013

(65) Prior Publication Data

US 2013/0239834 A1 Sep. 19, 2013

(30) Foreign Application Priority Data

Mar. 14, 2012 (DE) ..... 10 2012 004 966

(51) Int. Cl.

| | |
|---|---|
| ***F42B 3/12*** | (2006.01) |
| ***F42B 3/107*** | (2006.01) |
| ***F42D 1/05*** | (2006.01) |

(52) U.S. Cl.

CPC . *F42D 1/05* (2013.01); *F42B 3/107* (2013.01); *F42B 3/12* (2013.01)

USPC ..... 102/202.9; 102/202.7; 102/202.14

(58) Field of Classification Search

USPC ..... 102/202.5, 202.7, 202.9, 202.12, 102/202.14

See application file for complete search history.

(56) References Cited

U.S. PATENT DOCUMENTS

| | | | | |
|---|---|---|---|---|
| 3,134,329 | A * | 5/1964 | Zeman | 102/202.7 |
| 3,974,424 | A * | 8/1976 | Lee | 361/248 |
| 5,140,906 | A * | 8/1992 | Little, II | 102/202.14 |
| 5,230,287 | A | 7/1993 | Arrell, Jr. et al. | |
| 5,596,163 | A * | 1/1997 | Caflisch et al. | 102/202.2 |
| 5,639,986 | A * | 6/1997 | Evans | 102/531 |
| 5,845,578 | A * | 12/1998 | Fogle, Jr. | 102/202.5 |
| 5,932,832 | A * | 8/1999 | Hansen et al. | 102/202.4 |
| 5,942,717 | A | 8/1999 | Pathe et al. | |
| 5,988,069 | A | 11/1999 | Bailey | |
| 6,779,456 | B2 * | 8/2004 | Avetisian | 102/202.9 |

FOREIGN PATENT DOCUMENTS

| | | |
|---|---|---|
| DE | 44 29 175 | 3/1995 |
| DE | 696 03 082 | 11/1999 |

* cited by examiner

*Primary Examiner* — James S Bergin

(74) *Attorney, Agent, or Firm* — Collard & Roe, P.C.

(57) ABSTRACT

Igniter base for a pyrotechnic initiator has a glass base together with fused-in contact pins that function as a pole carrier and thus fixes the contact pins in secure correlation to one another. The end side of the glass base and the contact pins form a level plane, so that an ignition bridge resting flush on the glass base can be attached to the poles. The contact pins project beyond the glass base on the opposite side and a part of the glass base and a part of the contact pins projecting beyond the glass base are equipped with a plastic jacketing.

3 Claims, 1 Drawing Sheet

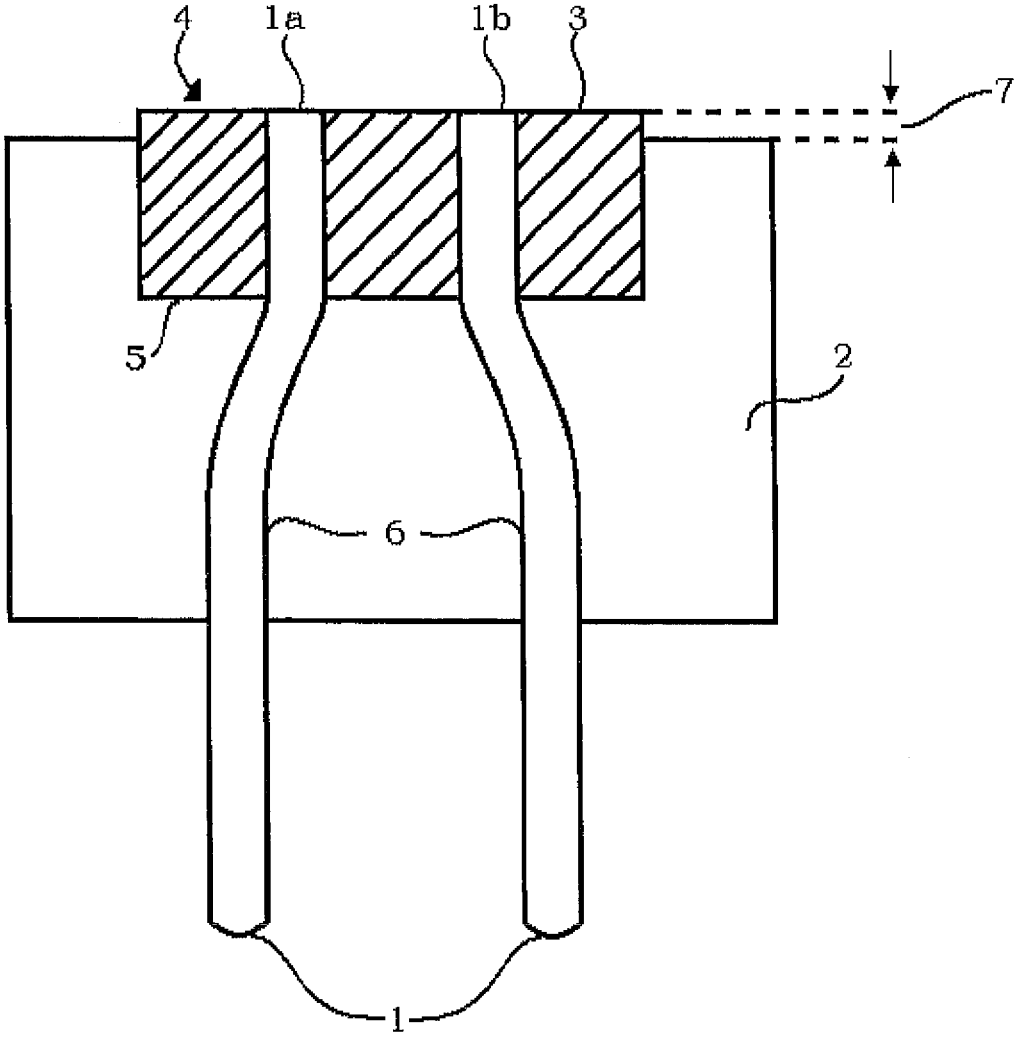
4
1a
1b
3
7
5
2
6
1

IGNITER BASE FOR PYROTECHNIC DEVICES

CROSS REFERENCE TO RELATED APPLICATIONS

Applicant claims priority under 35 U.S.C. §119 of German Application No. 10 2012 004 966.8 filed Mar. 14, 2012, the disclosure of which is incorporated by reference.

BACKGROUND OF THE INVENTION

1. Field of the Invention

Pyrotechnic initiators are needed in gas generators for passive safety systems such as airbags and belt tensioners in motor vehicles.

Such gas generators work with initiators, by means of which a propellant charge can be ignited pyroelectrically.

Such pyrotechnical devices guarantee a reliable ignition of the propellant charge and function flawlessly over many years. For this assignment, such devices must assure a function over decades.

This condition requires that a flawless function is guaranteed permanently and that the igniter and also the propellant charge are not changed during the service time. It must be assured that, for example, no moisture can penetrate into the gas generator. For this assurance, the propellant charge and the igniter must be hermetically encapsulated. At the same time, it must be assured that the gases are released in the correct direction upon the ignition of the propellant charge.

2. Description of the Related Art

Among electrically ignited devices, ignition elements or micro gas generators, two basic types now exist in order to anchor the two current-conducting contacts of a pyroelectric structural element in the base or pole carrier of such an igniter. For this anchoring, a pole carrier is needed in which one or more contact pins are embedded insulated from one another in gastight manner and can be guided from outside into the ignition device via the electrical pulses.

Essentially two methods, which respectively have specific advantages and disadvantages, have been adopted in practice.

1. Glass-to-Metal Seal

A corresponding glass-to-metal seal is characterized in that at least one of two or more contact pins is fused in glass and therefore fixed. The glass base in turn is anchored in a metal ring, which permits a gastight joint—for example by laser welding—for the remaining construction of the igniter and at the same time can form one pole of the electrical ignition device if necessary.

The construction of igniters and other pyrotechnical elements with glass-to-metal seal provides for making the container with the actual pyrotechnical ignition mass of metal and, after pressing onto the metal ring of the glass-to-metal seal, welding it with this metal ring.

After an ignition bridge has been installed on the contact pins and the actual pyrotechnical ignition mass has been installed, this already functional igniter can also be equipped with a plastic cap and if necessary overmolded by means of plastic, in such a way that a standardized interface with the system surrounding it is formed.

Such a construction can be inferred, for example from the publication DE 696 03 082 T2, which has as subject matter a pyrotechnical electrical igniter and a safety device containing such an igniter for motor vehicles. This ignition base formed as an electropyrotechnical switch has two electrical terminal pins which, embedded in a glass or ceramic body, are connected to one another by an electrical ignition bridge. This ignition bridge is formed as an electrical microcomponent.

A second unit forms the pyrotechnical part of the initiator or ignition element. This part consists of a metallic cup, which has an insulating insert, in which a pyrotechnical composition is housed.

The two units are pressed together with one another and hermetically laser-welded together with one another by means of the metal ring embracing the glass or ceramic base.

A space, which is filled with a helium-saturated material, is formed in the interior of the metallic cup, and so possible leaks of the initiator or ignition element can be detected.

The processes for this construction are very complex, in part because many expensive components are needed and in addition the number of manufacturing steps is high. In particular, the welding of the metal cup with a metal ring proves to be not unproblematic, because a test for absolute leaktightness of such an igniter is possible only conditionally and only with considerable complexity.

In order to be able to fix a bridge wire in a glass-to-metal sealed igniter to the contact pins in such a way that it then rests flat on the glass between the two contact pins, the surface must be reworked by grinding. An advantage of the glass, however, is that it has a much higher melting point than the bridge wire and thus no kind of cavities or other changes between glass, bridge wire and the ignition mixture can occur during the testing or ignition by means of a current pulse due to the heat development that then occurs.

Another configuration of the ignition base of the type under discussion follows from U.S. Pat. No. 5,988,069. The ignition base described in that publication also has two contact pins, insulated from one another, which are fixed in hermetically sealed manner in the ceramic base by means of glass seal. On its upper side, the ceramic base is combined with a metal base, through which the one contact pin is guided in insulated manner, whereas the other contact pin is securely connected in electrically conductive manner with the metal base. The metal base and the contact pin insulated from it are electrically connected with one another via a bridge wire. The bridge wire is in contact with an ignition charge and this ignition charge with a propellant charge. This arrangement is enclosed with a metal cup, which is hermetically laser-welded with the metal base. The metal cup is finally also covered by a plastic cap. Below, a further metal base encloses the ignition base, with which it is pressed with use of a seal.

This construction has the combination of a large number of different components with a corresponding number of working steps for its assembly, which is costly and from the viewpoint of production technology is complex.

In U.S. Pat. No. 5,230,287, an ignition element for a micro gas generator is described in which the ignition element is constructed in the form of a semiconductor bridge. The semiconductor bridge is housed together with a propellant batch in the form of a pyrotechnical compound in a metal container, which is joined in hermetically sealed manner with an electrically non-conducting base by means of an adhesive compound. Electrical contact pins, which extend up to the semiconductor bridge and via which an ignition of the propellant batch can be achieved from pyrotechnical material, are fixed in the base. At least one of the contact pins is then completely electrically insulated from the metal container, whereas the other is connected with the ground of the device. Both contact pins are retained in metal penetrations, in which they are fixed by means of glassy insulating seals. The contact pins with their metal guides are additionally fixed in a central body and in the container with the pyrotechnical material by means of a semi-rigid adhesive, which represents a second hermetic seal. This construction is also complex and therefore costly.

2. Plastic-to-Metal Seal

The plastic-to-metal seal represents a further possibility for the formation of an ignition base of the type under discussion.

In this construction, the contact pins are anchored directly in a plastic base, which simultaneously forms the standardized interface to the system surrounding it. A possible and practiced manufacturing method is then to insert the contact pins into an injection-molding die and then to overmold them. This type of sealing has the advantage that only one or more contact pins and the plastic are needed in order to manufacture the component. Thus few and in addition inexpensive supply materials are necessary for a reduced number of process steps.

Disadvantageously, it turns out that the coefficients of expansion between contact pin and plastic lie very far apart from one another and that the plastic can melt above 300° C. A bridge wire, which can reach between 600° C. and 1,000° C. during ignition, in this case melts a part of the base, so that bridge wire and ignition mixture in this region are no longer joined to one another in the original manufacturing condition. Furthermore it is disadvantageous that, according to specifications usual today, round contact pins are required, which during insertion into an injection-molding die can be fixed only in longitudinal direction. Thus the contact pin can be turned inside the die; if a bending or crimping of the contact pin or pins is then still necessary, the position of the contact pins can no longer be correctly controlled for fixing the bridge wire, so that an absolute reproducibility of the required arrangement is not given. As a solution to this problem, as a rule the approach is taken that the contact pins are lengthened in such a way that they can be fixed at both ends in the die, which entails a projecting length.

Because the surface for the bridge wire must be very clean and even and should not have any raised sites, grinding of the contact pins (as also for the glass-to-metal seal) must consequently be carried out subsequently at this place. Once again metal and plastic behave very differently during this grinding, so that it cannot always be guaranteed that a clean and smooth surface is then achieved.

SUMMARY OF THE INVENTION

The task underlying the present invention is to avoid the inadequacies shown in the foregoing in the state of the art for the manufacture of a pyrotechnic initiator and at the same time to combine its advantages in inventive manner, as well as to simplify the construction of the ignition device to the effect that an additional metal ring is no longer necessary for the glass base.

The combination, configured according to the invention, of a glass-to-metal-seal with a plastic-to-metal seal of the contact pins in a pole carrier follows from the features of ignition base and method according to the invention. Further advantageous configurations of the invention are discussed below.

A combination of a glass-to-metal seal with a plastic-to-metal seal is already described in Patent Specification DE 44 29 175 B4. Therein contact pins are fused into a glass base, which in turn is equipped with a gauge ring. The free ends of the contact pins are back-injected with plastic at the terminal on the glass base in such a way that a defined flashover spark gap is formed between a galvanically conducting ring and the contact pins, with which the hazardous voltage peaks are diverted to the galvanically conducting ring.

The embedding of the contact pins in plastic then serves as the further fixation of the free ends of the contact pins. In addition, the entire construction is also enclosed by an aluminum housing.

The combination of different materials in the construction of the known ignition base, such as glass, into which contact pins are fused, stainless steel (Cr/Ni alloy) for a conducting ring, Ni/Fe alloy for the contact pins, with an additional gold plating in the terminal region, an Ni/Cr alloy for the ignition bridge, aluminum for the housing and plastic in the form of glass-fiber-reinforced polyamide with respectively different coefficients of thermal expansion, already represents in itself a problem for a hermetic seal of the interior space of an ignition device. This problem becomes even more acute when it is considered that temperature differences on the order of magnitude of up to 120 K and more can occur in a motor vehicle, which can entail not inconsiderable relative movements of the individual materials used and combined with one another. It is also understandable that a seal ring of an elastomer is necessary in the known ignition device in order to compensate for thermal expansions of the various components. The aging resistance of the sealing material used can also lead to problems.

Likewise contact corrosion due to weather influences and humidity can occur between individual materials that are far apart from one another in the electrochemical series.

Furthermore, the entire construction, as it follows from the cited state of the art, is complex both because of the materials and also the necessary process steps and consequently is very costly.

In contrast to this state of the art, the combination according to the invention of a glass-to-metal seal with a plastic-to-metal seal in the inventive configuration permits both a hermetic seal of the ignition base against external influences, such as, for example, humidity, and also the simple construction of the terminal on the form of the interface of a surrounding system. In addition, an inexpensive manufacture of the ignition base is achieved according to the present invention.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

In the drawing,

The sole FIGURE shows a cross section through an igniter base according to the invention.

DETAILED DESCRIPTION OF PREFERRED EMBODIMENTS

Two doubly crimped contact pins 1 are fused into a glass base 3 and at the end face 4 of the glass base 3 form a plane therewith. On the opposite side 5, the contact pins 1 project out of the glass base 3.

Below the end face 4, the glass base 3 and a part 6 of the contact pins 1 is overmolded with a plastic jacketing 2. The plastic overmolding or jacketing is offset or set back slightly 7 relative to the end face 4 of the glass base 3.

At the end face 4 of the glass base 3, the contact pins 1 form contact poles 1*a* and 1*b* respectively for the seat of an ignition bridge, not illustrated, which connects the poles galvanically. The ignition bridge can be both welded fusionally with the poles and also joined thereto by simple contact, in that it is held in galvanic contact with the poles by the solid ignition compound.

The plastic jacketing 2 permits both a hermetic joint with a container enclosing the pyrotechnical ignition compound and also an interface to the surrounding system, wherein the ends of the contact pins 1 projecting outwardly beyond the plastic base 2 function as electrical contacts.

Because of the overmolding of the glass base with plastic according to the invention, expulsion of the glass base 3 from the pyroelectric ignition device is securely suppressed and at the same time extraction of the parts 6 of the contact pins is prevented.

A method for manufacture of the ignition base according to the invention is described as follows:

Starting from a glass base in which the two contact pins are fused, with avoidance of an additional metal ring for the glass base, this glass base is then post-machined by grinding, so that a suitable plane surface is produced, in order that an ignition bridge, which rests on the glass base between the poles 1*a* and 1*b* respectively of the contact pins, can be attached in a later working step. This subassembly can then be inserted into an injection-molding die and overmolded with plastic, without necessitating a further post-treatment.

It is advantageous in this case that the contact pins are already fixed by the glass and can no longer be changed in radial position inside the cavity, which acts positively on the attainable tolerances of the contact-pin spacing relative to one another.

The pole carrier manufactured in this way is then inserted in a further working step into the injection-molding die, fixed therein and then overmolded with plastic. For fixation of the pole carrier in the injection-molding die, seats are formed therein that receive on the one hand the ends of the contact pins projecting beyond the glass base and on the other hand a short portion of the end side of the glass base. Therewith it is achieved that the pole carrier is securely fixed in the injection-molding die and can be overmolded by plastic compound without necessitating any further post-machining.

After removal of the igniter base from the injection-molding die, the attachment of a bridge wire or an ignition bridge can then be carried out. As a rule, the attachment is accomplished by a welded joint, wherein it is ensured that the bridge wire or the ignition bridge between the poles of the contact pins rests on the glass base between the contact pins.

Then the igniter base formed in this way is completed with a plastic cup, which contains the pyrotechnics and which can be hermetically joined sealingly by means of conventional technology with the plastic jacket of the pole carrier. The advantages of the plastic-to-metal sealed igniter are utilized for this purpose.

Although only at least one embodiment of the present invention has been shown and described, it is to be understood that many changes and modifications may be made hereunto without departing from the spirit and scope of the invention.

What is claimed is:

1. An ignition base for a pyroelectric ignition device comprising:

a pole carrier comprising a glass base, said pole carrier comprising a first side and a second side opposite to the first side;

contact pins embedded in the glass base, said contact pins and the glass base forming a planar end face on the first side, said contact pins projecting beyond the glass base on the second side; and a plastic jacketing contacting the glass base under the end face to form an enclosure covering the glass base except for a first portion of the glass base and a part of the contact pins projecting beyond the glass base;

wherein the plastic jacketing is set back relative to the end face so that the first portion is not covered by the plastic jacketing, the first portion extending from the plastic jacketing to the first side.

2. The ignition base according to claim 1, further comprising an ignition bridge resting flush on the glass base, wherein said ignition bridge is attached in electrically conductive manner to poles of the contact pins.

3. A pyroelectric ignition device comprising:

an ignition base comprising:

a pole carrier comprising a glass base, said pole carrier comprising a first side and a second side opposite to the first side;

contact pins embedded in the glass base, said contact pins and the glass base forming a planar end face on the first side, said contact pins projecting beyond the glass base on the second side; and a plastic jacketing contacting the glass base under the end face to form an enclosure covering the glass base except for a first portion of the glass base and a part of the contact pins projecting beyond the glass base;

a pyrotechnical ignition compound; and a container enclosing the pyrotechnical ignition compound;

wherein the plastic jacketing is set back relative to the end face so that the first portion is not covered by the plastic jacketing, the first portion extending from the plastic jacketing to the first side;

wherein the plastic jacketing of the ignition base hermetically joins the container with the ignition base; and wherein the plastic jacketing serves as an interface.

* * * * *